US009115706B2

(12) United States Patent
Ohno et al.

(10) Patent No.: US 9,115,706 B2
(45) Date of Patent: Aug. 25, 2015

(54) COMPRESSOR

(71) Applicant: Kabushiki Kaisha Toyota Jidoshokki, Toyoda-cho, Kariya-shi, Aichi-ken (JP)

(72) Inventors: Masami Ohno, Kariya (JP); Masakazu Obayashi, Kariya (JP); Shinichi Sato, Kariya (JP); Akio Saiki, Kariya (JP); Akihiro Nakashima, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 359 days.

(21) Appl. No.: 13/846,872

(22) Filed: Mar. 18, 2013

(65) Prior Publication Data

US 2013/0251548 A1 Sep. 26, 2013

(30) Foreign Application Priority Data

Mar. 23, 2012 (JP) ..... 2012-067753

(51) Int. Cl.
*F04B 23/00* (2006.01)
*F04B 15/00* (2006.01)
(Continued)

(52) U.S. Cl.
CPC ..... *F04B 15/00* (2013.01); *F04C 18/02* (2013.01); *F04C 18/0215* (2013.01); *F04C 29/026* (2013.01)

(58) Field of Classification Search
CPC ..... F04C 18/02; F04C 18/0215; F04C 29/026
USPC ..... 417/313; 55/459.1, 462, 450, 451
See application file for complete search history.

(56) References Cited

U.S. PATENT DOCUMENTS 6,237,362 B1 * 5/2001 Jang ..... 62/469
2002/0134101 A1 9/2002 Gennami et al.
2004/0126252 A1 * 7/2004 Abe et al. ..... 417/410.5
(Continued)

FOREIGN PATENT DOCUMENTS

EP 1908957 4/2008
JP 2003-336588 A 11/2003
(Continued)

OTHER PUBLICATIONS

English translation of Chinese Patent Application No. 201310090706.7: First Office Action dated Apr. 3, 2015, 17 pages.

*Primary Examiner* — Charles Freay
(74) *Attorney, Agent, or Firm* — Baker & Hostetler LLP

(57) ABSTRACT

A compressor includes a housing, compression unit, discharge chamber, outlet, and oil separation structure. The oil separation structure, which is arranged between the discharge chamber and the outlet, includes an oil reservoir, oil separation compartment, intake passage, exhaust passage, and supply passage. The oil separation compartment is located upward from the oil reservoir. The intake passage, which extends upward from the oil separation compartment, draws refrigerant gas into the oil separation compartment from the discharge chamber to separate lubrication oil from the refrigerant gas. The exhaust passage extends upward from the oil separation compartment and discharges the refrigerant gas in the oil separation compartment out of the housing through the outlet. The supply passage extends upward from the oil separation compartment and has a larger cross-sectional area than the intake passage. The supply passage supplies the oil reservoir with lubrication oil from the oil separation compartment.

11 Claims, 6 Drawing Sheets

(51) Int. Cl.
*F04C 29/02* (2006.01)
*F04C 18/02* (2006.01)

(56) References Cited

U.S. PATENT DOCUMENTS

| | | | | |
|---|---|---|---|---|
| 2005/0072307 | A1 | 4/2005 | Bhatia et al. | |
| 2006/0171832 | A1* | 8/2006 | Oiwake | 418/55.6 |
| 2011/0044835 | A1 | 2/2011 | Nomura | |
| 2011/0146215 | A1* | 6/2011 | Lee et al. | 55/456 |
| 2011/0211977 | A1 | 9/2011 | Nomura et al. | |
| 2012/0213648 | A1* | 8/2012 | Nakashima et al. | 417/313 |
| 2013/0034461 | A1* | 2/2013 | Mitsui et al. | 418/55.6 |

FOREIGN PATENT DOCUMENTS

| | | | |
|---|---|---|---|
| JP | 2004-052710 | A | 2/2004 |
| JP | 2005-113917 | A | 4/2005 |
| JP | 2005-320873 | A | 11/2005 |
| JP | 2007-009776 | A | 1/2007 |
| JP | 2008-196422 | A | 8/2008 |
| JP | 2009-235910 | A | 10/2009 |
| WO | 2013/165157 | * | 7/2013 |

* cited by examiner

COMPRESSOR

CROSS REFERENCE TO RELATED APPLICATIONS

This application claims priority to Japanese Patent Application No. 2012-067753 filed Mar. 23, 2012.

BACKGROUND

The present invention relates to a compressor provided with a housing including a compression unit, which draws in refrigerant gas, compresses the refrigerant gas, and then discharges the refrigerant gas from a discharge chamber through an outlet and out of the housing, and an oil separation structure, which is arranged between the discharge chamber and the outlet to separate lubrication oil from the refrigerant gas.

A typical compressor for a vehicle air conditioner uses lubrication oil, which is suspended in a refrigerant gas, to lubricate parts such as a compression mechanism when the refrigerant gas circulates through the housing of the compressor. Thus, such a compressor includes an oil separation mechanism, which is arranged in a discharge line, to confine the lubrication oil to the compressor and prevent the lubrication oil from escaping into an external refrigerant circuit together with the refrigerant gas. Japanese Laid-Open Patent Publication No. 2005-320873 describes an example of a whirling type oil separation structure. Referring to FIG. 9A, in Japanese Laid-Open Patent Publication No. 2005-320873, an oil separator 80 is arranged in a compression casing 81 between a discharge chamber 82 and an outlet 83. The oil separator 80 includes a separation compartment 84 and a separation tube 85. The separation tube 85 is press-fitted into and fixed to the separation compartment 84. An annular void is formed between the wall surface of the separation compartment 84 and the outer surface of the separation tube 85. An oil passage 87, which is in communication with an oil reservoir 86, is formed below the separation compartment 84.

The refrigerant gas in the discharge chamber 82 enters the separation compartment 84 of the oil separator 80. The refrigerant gas then whirls around the outer surface of the separation tube 85 as it descends in the separation compartment 84. This applies centrifugal force to the refrigerant and separates lubrication oil from the refrigerant gas. The lubrication oil collects on the wall surface of the separation compartment 84. Then, the refrigerant gas flows through the separation tube 85 and is discharged out of the outlet 83.

Japanese Laid-Open Patent Publication No. 2009-235910 describes an example of an impingement type oil separation structure. Referring to FIG. 9B, a gas compressor 90 described in Japanese Laid-Open Patent Publication No. 2009-235910 includes a casing 91 that accommodates a compression mechanism (not shown) and a baffling passage 92, through which compressed refrigerant gas flows. The baffling passage 92 is formed by staggering a series of fin-shaped baffles 94 between the casing 91 and an opposing portion of a rear block 93. An oil reservoir (not shown) that accumulates separated lubrication oil is arranged between the casing 91 and the rear block 93.

When refrigerant gas flows through the baffling passage 92, the refrigerant gas repetitively impinges against bent portions 95 formed between the baffles 94. The difference in specific gravity separates lubrication oil from the refrigerant gas. The refrigerant gas is discharged out of the gas compressor 90, whereas the lubrication oil is accumulated in the oil reservoir.

In the whirling type oil separation structure such as the oil separator 80 of Japanese Laid-Open Patent Publication No. 2005-320873 that uses a separation tube 85, the separation tube 85 should have a particular length and diameter to whirl the refrigerant gas about the separation tube 85 in a preferable manner and obtain the required performance for separating lubrication oil. Thus, there is a tendency for the oil separation structure to be large, and the freedom of layout is thereby limited.

In the impingement type oil separation structure such as that of Japanese Laid-Open Patent Publication No. 2009-235910 that uses the baffling passage 92, the baffling passage 92 should have a particular length and a particular number of bent portions 95 to induce refrigerant gas impingement against the bent portions 95 a desired number of times. Thus, the oil separation structure tends to be large. Further, as the lubrication oil separated from the baffling passage 92 meanders through the baffling passage 92, the lubrication oil may fill the baffling passage 92. In this case, the lubrication oil may flow backward to the compression mechanism, and the lubrication oil may be carried by the refrigerant gas to the external refrigerant circuit.

SUMMARY

It is an object of the present invention to provide a compressor that allows an oil separation mechanism to be reduced in size, have a higher freedom of layout, and impede the escape of lubrication oil from the compressor.

To achieve the above object, one aspect of the present invention is a compressor including a housing, a compression unit, a discharge chamber, an outlet, and an oil separation structure. The compression unit is arranged in the housing and draws in, compresses, and discharges refrigerant gas. The discharge chamber is in communication with the compression unit. The outlet is in communication with the discharge chamber. The outlet is formed in the housing to discharge the refrigerant gas out of the housing. The oil separation structure, which is arranged between the discharge chamber and the outlet, separates lubrication oil from the refrigerant gas and accumulates separated lubrication oil. The oil separation structure includes an oil reservoir that accumulates the lubrication oil separated from the refrigerant gas. An oil separation compartment is located upward from the oil reservoir and is in communication with the oil reservoir. An intake passage extends upward from the oil separation compartment and is in communication with the discharge chamber. The intake passage draws the refrigerant gas from the discharge chamber into the oil separation compartment to separate the lubrication oil from the refrigerant gas. An exhaust passage extends upward from the oil separation compartment and is in communication with the outlet. The exhaust passage discharges the refrigerant gas from the oil separation compartment through the outlet and out of the housing. A supply passage extends upward from the oil separation compartment and has a larger cross-sectional area than the intake passage. The supply passage supplies the separated lubrication oil from the oil separation compartment to the oil reservoir.

In the above structure, refrigerant gas is drawn from the discharge chamber through the intake passage and into the oil separation compartment. The intake passage increases the flow velocity of the refrigerant gas. When the refrigerant gas, of which the flow velocity has been increased, blows into the oil separation compartment, the lubrication oil suspended in the refrigerant gas remains on the wall surface of the oil separation compartment due to surface tension. Thus, the refrigerant gas separated from the lubrication oil is drawn into the exhaust passage, which is in communication with the outlet, and discharged from the oil separation compartment out of the housing. In this manner, the oil separation compartment separates refrigerant gas and lubrication oil and impedes the escape of the separated lubrication oil out of the housing and into the exterior.

Further, the supply passage has a larger cross-sectional area than the intake passage. Thus, the lubrication oil separated in the oil separation compartment does not clog the supply passage and can be smoothly supplied from the oil separation compartment to the supply passage. Moreover, the lubrication oil collected on the wall surface of the oil separation compartment is conveyed along the wall surface and supplied to the supply passage. Since the supply passage extends upward from the oil separation compartment, the velocity of the lubrication oil decreases as it moves along the wall surface. This prevents the lubrication oil from the supply passage from entering the oil reservoir with great force. In this manner, the oil separation structure includes three passages in communication with the oil separation compartment. The passages have different cross-sectional areas, adjust the flow velocity of the refrigerant gas, and adjust the direction in which the lubrication oil flows. This efficiently separates the lubrication oil and impedes the escape of lubrication oil to the exterior. In addition to the oil separation compartment and the oil reservoir, the oil separation structure merely extends three passages upward from the oil separation compartment. This efficiently separates lubrication oil, and the oil separation structure, which efficiently separates lubrication oil from refrigerant gas, can be reduced in size in the vertical direction.

The oil separation structure of the present invention can separate lubrication oil from refrigerant gas in the passages and compartments of the housing. Thus, there is no need for a separation tube like in a whirling type oil separation structure. Further, in the oil separation structure of the present invention, there is no need for a baffling passage used for refrigerant gas impingement and the arrangement of a large number of impingement sections like in an impingement type oil separation structure. Thus, the compressor of the present invention allows for reduction in size of the oil separation structure as compared with a whirling type or impingement type oil separation structure. This increases the freedom of layout for the compressor.

Preferably, the intake passage, the exhaust passage, and the supply passage are arranged next to one another. Further, the exhaust passage is arranged between the intake passage and the supply passage.

In the above structure, the refrigerant gas flows from the discharge chamber through the intake passage and into the oil separation compartment, which separates lubrication oil from the refrigerant gas. Then, the refrigerant gas is discharged from the oil separation compartment. Further, the exhaust passage is located next to the intake passage. Thus, the refrigerant gas is readily transferred to the exhaust passage. In the oil separation compartment, the lubrication oil is conveyed along the wall surface toward the supply passage. The supply passage is farthest from the intake passage. Thus, the oil separation compartment efficiently separates refrigerant gas and lubrication oil when the lubrication oil is conveyed along the wall surface.

Preferably, the exhaust passage includes an inlet, which is in communication with the oil separation compartment, and a large diameter portion, which is located at a downstream side of the inlet and has a larger cross-sectional area than the inlet.

In the above structure, the flow velocity of the refrigerant gas, which is drawn into the exhaust passage, decreases at the large diameter portion. Thus, even when lubrication oil is suspended in the refrigerant gas that is drawn into the exhaust passage, the lubrication oil can be separated from the refrigerant gas when passing through the exhaust passage.

Preferably, the oil separation compartment includes a bottom surface that is recessed in an arcuate manner.

In the above structure, the refrigerant gas, which is drawn into the oil separation compartment, whirls along the bottom surface of the oil separation compartment. This separates lubrication oil from the refrigerant gas.

Preferably, part of the supply passage, which extends from the oil separation compartment, forms a backflow preventing portion that extends back toward the oil separation compartment.

In the above structure, when lubrication oil is conveyed along the wall surface of the supply passage, even if the lubrication oil flows back toward the oil separation compartment, the lubrication oil flows into the backflow preventing portion. This decreases the amount of lubrication oil that flows backward from the supply passage to the oil separation compartment.

Preferably, the oil separation structure includes a bypass passage that communicates the supply passage with a portion of the oil separation structure that is located closer to the exhaust passage than the outlet.

In the above structure, the refrigerant gas that passes through the exhaust passage enters a portion of the oil separation structure located closer to the exhaust passage than the outlet. Here, the lubrication oil carried out of the oil separation compartment is separated from the refrigerant gas. The separated lubrication oil is returned to the supply passage through the bypass passage.

Preferably, the oil separation structure includes a throttle arranged between the supply passage and the oil reservoir.

In the above structure, even when refrigerant gas flows into the supply passage, the throttle prevents the refrigerant gas from flowing into the oil reservoir with great force.

Preferably, the exhaust passage includes a throttle and a trap. The throttle is recessed in the exhaust passage in a direction intersecting a direction in which the refrigerant gas flows through the exhaust passage. The trap is located in a portion of the exhaust passage that is closer to the oil separation compartment than the throttle. The trap has a larger cross-sectional area than the throttle.

In the above structure, when lubrication oil is carried into the exhaust passage and conveyed along the wall surface of the exhaust passage, the lubrication oil enters the trap. This prevents the lubrication oil from flowing further downstream from the throttle.

Preferably, the housing includes a first wall, which partitions the intake passage and the exhaust passage, and a second wall, which partitions the exhaust passage and the supply passage. The first wall and the second wall extend parallel to each other.

In the above structure, the supply passage extends generally straight upward from the oil separation compartment. This ensures that the lubrication oil separated in the oil separation compartment in decreased in velocity when conveyed along the wall surface of the oil separation compartment. Thus, lubrication oil is prevented from entering the supply passage with great force.

Preferably the compressor further includes a suction chamber, which draws in the refrigerant gas, and an oil supply communication passage, which communicates the suction chamber and the oil reservoir.

In the above structure, after the oil separation structure separates lubrication oil from the refrigerant gas, the lubrication oil can be returned through the oil supply communication passage to the suction chamber, which has a lower pressure than the oil reservoir. Thus, the lubrication oil separated from the refrigerant gas is returned to the refrigerant gas to lubricate the compression unit and the like in a state suspended in the refrigerant gas. Accordingly, the lubrication oil lubricates the compression unit and the like, and the lubrication oil is not carried out of the housing.

Preferably, the housing includes a plurality of housing formation members. The oil separation compartment and the oil reservoir are formed by coupling the housing formation members.

In this structure, the oil separation compartment and oil reservoir are formed over a plurality of housing formation members. This allows for an increase in the volumes of the oil separation compartment and oil reservoir in comparison to when they are formed in, for example, only one housing formation member. Further, the oil separation compartment and oil reservoir can be formed by coupling the housing formation members in a state opposed to each other. This facilitates the manufacturing of the oil separation structure and lowers the cost of the compressor.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF ILLUSTRATIVE EMBODIMENTS

A scroll compressor 10, which is one embodiment of a compressor according to the present invention, will now be described with reference to FIGS. 1 to 4.

Figure 1:
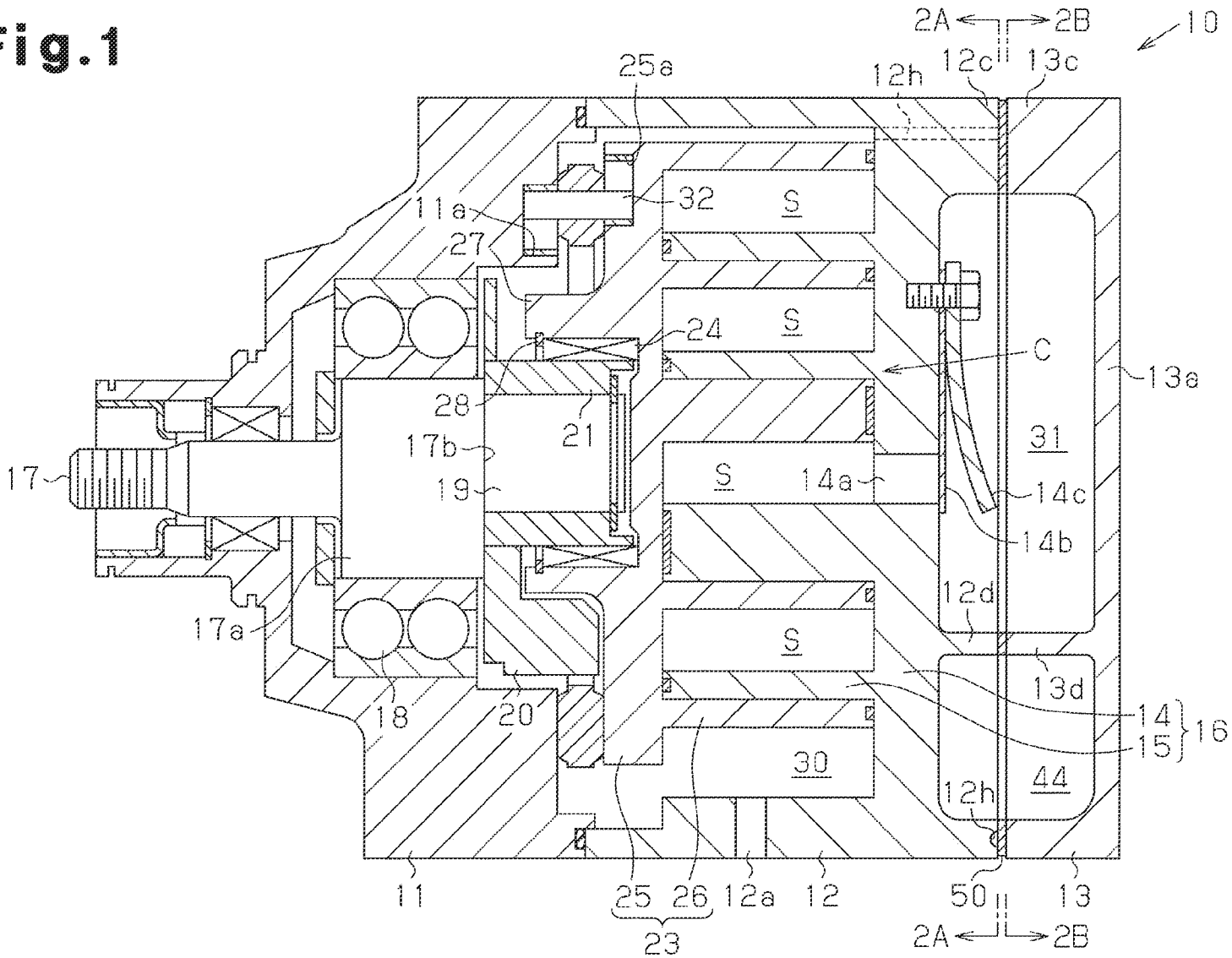
FIG. 1 is a cross-sectional view showing a compressor according to one embodiment of the present invention.

As shown in FIGS. 1 and 2, the scroll compressor 10 is provided with a housing including a center housing 12 (shell), which has a first end and second end, a front housing 11, which is coupled to the first end of the center housing 12, and a rear housing 13, which is coupled to the second end of the center housing 12. The front housing 11, center housing 12, and rear housing 13 are fastened together by fasteners B. The front housing 11, center housing 12, and rear housing 13 each define a housing formation member that forms the housing of the compressor 10.

As shown in FIG. 1, the housing of the scroll compressor 10 includes a scroll type compression unit C that compresses refrigerant gas. In detail, the center housing 12 is cylindrical and includes a closed end and an open end, which faces the front housing 11. A fixed scroll 16, which forms the compression unit C, is fixed in the center housing 12. The fixed scroll 16 includes a fixed base plate 14, which forms the closed end of the center housing 12, and a fixed spiral wall 15, which extends from the fixed base plate 14 toward the front housing 11.

A rotation shaft 17, which includes a large diameter portion 17*a*, is arranged in the front housing 11. A radial bearing 18 supports the large diameter portion 17*a* in a rotatable manner. The large diameter portion 17*a* includes an end face 17*b* that is proximal to the fixed scroll 16. An eccentric shaft 19 is formed integrally with the end face 17*b*. The eccentric shaft 19 has an axis separated from that of the rotation shaft 17.

The eccentric shaft 19 supports a balance weight 20 and bushing 21, which are rotatable relative to each other. A movable scroll 23, which forms the compression unit C, is supported by a bearing 24 on the bushing 21. The movable scroll 23 is rotatable relative to the bushing 21 and faces the fixed scroll 16. The movable scroll 23 includes a movable base plate 25 that faces the fixed base plate 14. A movable spiral wall 26, which is fitted to the fixed spiral wall 15, projects from the movable base plate 25.

A compression chamber S having a variable volume is formed in between the fixed base plate 14 and fixed spiral wall 15 of the fixed scroll 16 and the movable base plate 25 and movable spiral wall 26 of the movable scroll 23. The fixed base plate 14 includes a discharge port 14*a*, which is in communication with the compression chamber S. A discharge valve 14*b* is fixed to the fixed base plate 14 to open and close the discharge port 14*a*. A retainer 14*c* is fixed to the fixed base plate 14 to restrict the open amount of the discharge valve 14*b*.

The center housing 12 and rear housing 13 form a discharge chamber 31, which is in communication with the discharge port 14*a*. A suction chamber 30, which serves as a suction portion of the compression unit C, is defined between the circumferential wall of the center housing 12 and the outermost portion in the movable spiral wall of the movable scroll 23. Accordingly, the suction chamber 30 is arranged in the outer section of the compression unit C. Further, the circumferential wall of the center housing 12 includes a suction port 12*a*, which is in communication with the suction chamber 30.

The end face of the front housing 11 includes a plurality of rotation restriction holes 11 a arranged near the circumference of the movable base plate 25 along the circumferential direction of the movable base plate 25. The movable base plate 25 also includes rotation restriction holes 25*a* arranged along the circumferential direction of the movable base plate 25. The number of the rotation restriction holes 25*a* is the same as the number of the rotation restriction holes 11*a*. Ends of rotation restriction pins 32 are inserted into the rotation restriction holes 25*a*.

The rotation of the rotation shaft 17 and the eccentric shaft 19 produces an orbiting motion of the movable scroll 23. Refrigerant gas, which is drawn through the suction port 12*a* into the suction chamber 30, enters the gaps between the fixed base plate 14 and the movable base plate 25. As the movable scroll 23 orbits, the circumferential surface of each rotation restriction pin 32 slides along the wall surfaces of the rotation restriction holes 11*a* and 25*a*. Thus, the movable scroll 23 orbits without rotating. Further, the orbiting of the movable scroll 23 converges the compression chamber S toward inner terminal ends of the spiral walls 15 and 26 in the two scrolls 16 and 23, while decreasing the volume of the compression chamber S. The decrease in the volume of the compression chamber S compresses the refrigerant gas, which is discharged out of the discharge port 14*a* and into the discharge chamber 31.

Figure 3:
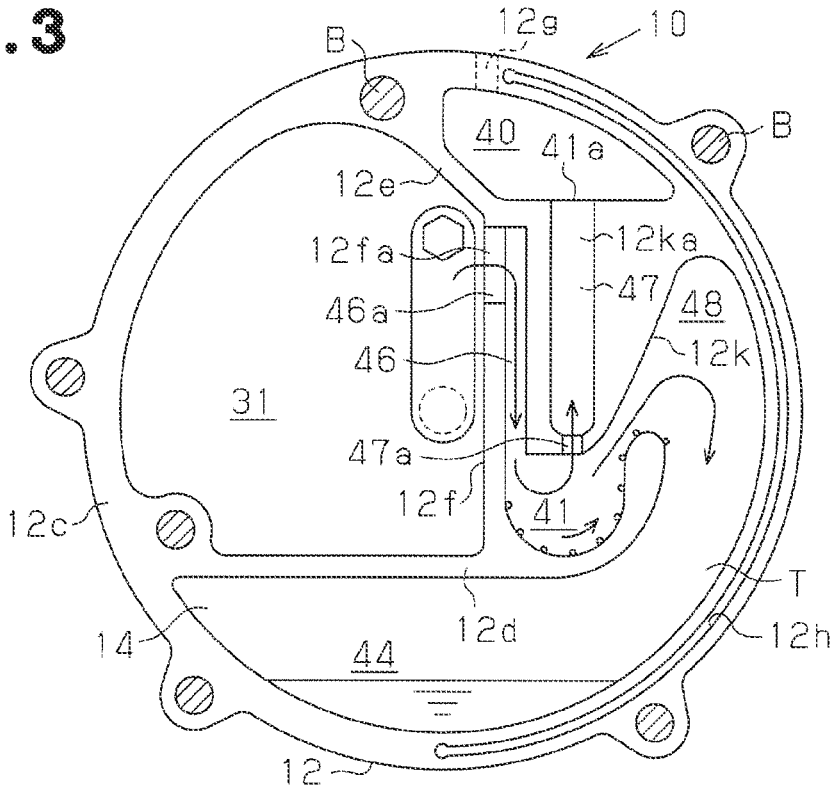
FIG. 3 is a cross-sectional view showing an oil separation structure of the compressor of FIG. 1.

As shown in FIG. 3, when the center housing 12 and rear housing 13 are coupled, a muffler compartment 40, an oil separation compartment 41, an oil reservoir 44, an intake passage 46, an exhaust passage 47, and a supply passage 48 are formed in the housing.

Figure 2A:
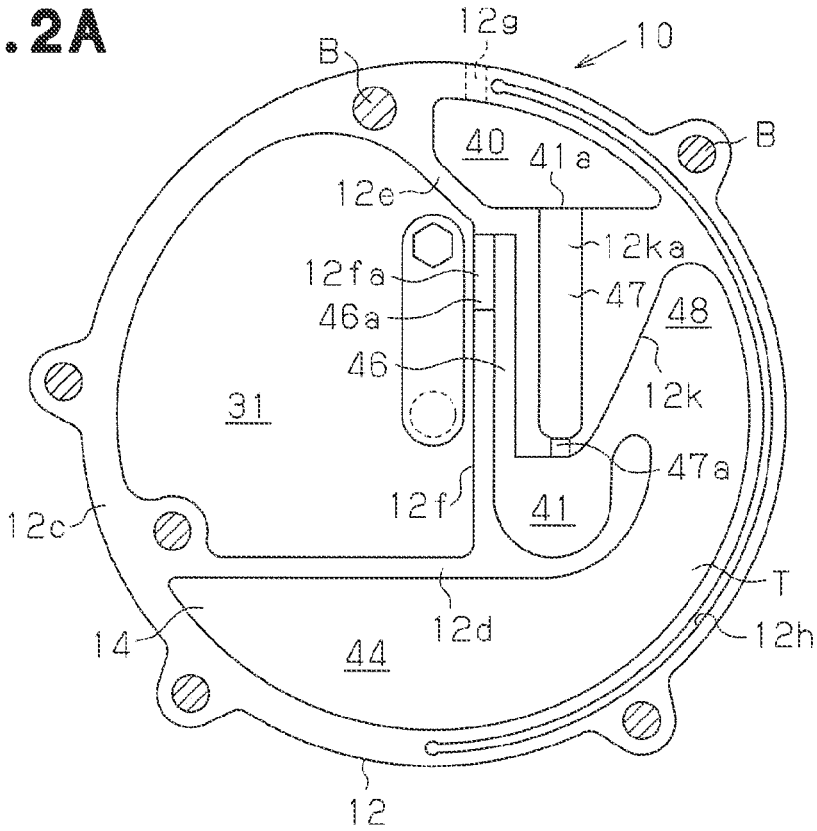
FIG. 2A is a cross-sectional view taken along line 2A-2A in FIG. 1.
Figure 2B:
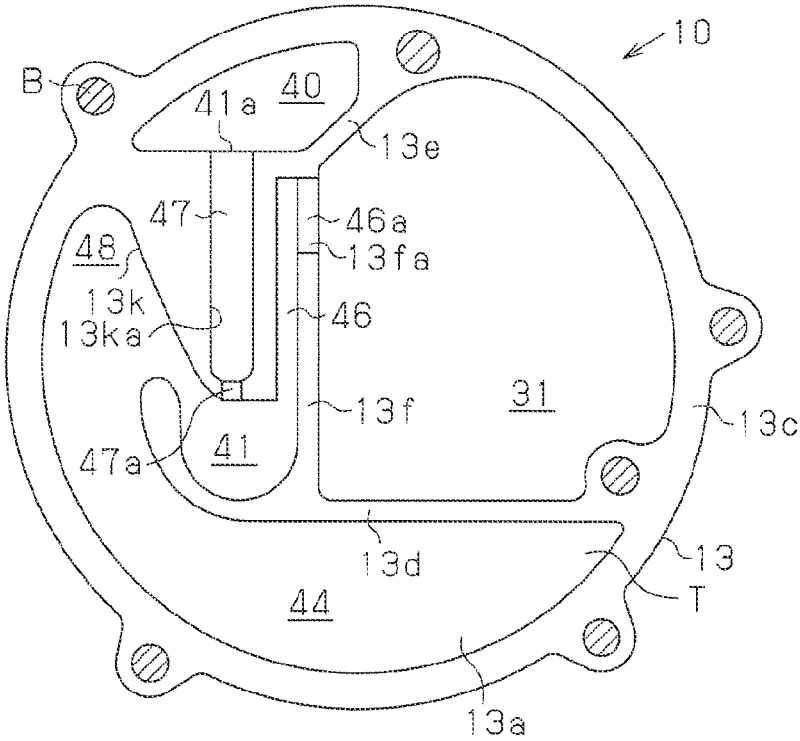
FIG. 2B is a cross-sectional view taken along line 2B-2B in FIG. 1.

As shown in FIG. 2A, the fixed base plate 14 in the center housing 12 includes an annular center housing circumferential wall 12*c*, which projects toward the rear housing 13 from the circumference of the fixed base plate 14. Further, as shown in FIG. 2B, the rear housing 13 includes a closed end 13*a*. An annular rear housing circumferential wall 13*c* projects from the circumference of the closed end 13*a* toward the center housing circumferential wall 12*c*. As shown in FIG. 1, in a state in which the center housing 12 and rear housing 13 are coupled to each other, a gasket 50 is held between the center housing 12 and rear housing 13. The gasket 50 impedes the leakage of refrigerant gas and lubrication oil from the muffler compartment 40, the oil separation compartment 41, the oil reservoir 44, the exhaust passage 47, and the supply passage 48.

As shown in FIGS. 2A and 2B, a vertically lower portion in the fixed base plate 14 includes a first wall 12*d*, which extends laterally from a portion of the center housing circumferential wall 12*c* and then curves upward. Further, a vertically lower portion in the closed end 13*a* of the rear housing 13 includes a first wall 13*d*, which extends laterally from part of the rear housing circumferential wall 13*c* and then curves upward. In this manner, the first wall 13*d* includes a distal portion that is arcuate and curved upward.

A vertically upper portion in the fixed base plate 14 includes a second wall 12*e*, which connects two locations on the center housing circumferential wall 12*c*. The fixed base plate 14, the second wall 12*e*, and the center housing circumferential wall 12*c* encompass a void that forms a part of the muffler compartment 40. Further, a partition wall 12*k* (partition) extends from the second wall 12*e* toward the first wall 12*d*. A clearance is formed between a distal end of the partition wall 12*k* and the first wall 12*d*. The partition wall 12*k* includes a hollow passage formation portion 12*ka*, which extends in the vertical direction.

As shown in FIG. 2B, a vertically upper portion in the closed end 13*a* of the rear housing 13 includes a second wall 13*e*, which connects two locations on the rear housing circumferential wall 13*c*. The closed end 13*a*, second wall 13*e*, and rear housing circumferential wall 13*c* encompass a void that forms part of the muffler compartment 40. Further, a partition wall 13*k* (partition) extends from the second wall 13*e* toward the first wall 13*d*. A clearance is formed between a distal end of the partition wall 13*k* and the first wall 13*d*. The partition wall 13*k* includes a hollow passage formation portion 13*ka*, which extends in the vertical direction.

Referring to FIG. 3, the center housing 12 and rear housing 13 are coupled, and the two muffler compartments 40 are joined with each other. Thus, a single muffler compartment 40 is formed in the housing. The muffler compartment 40 is in communication with an outlet 12*g*, which is formed in the center housing circumferential wall 12*c*. The outlet 12*g* leads to the exterior of the housing.

As shown in FIG. 2A, the fixed base plate 14 includes a third wall 12*f* that extends in the vertical direction and connects the first wall 12*d* and second wall 12*e*. The third wall 12*f* has a clearance of a fixed distance from the partition wall 12*k*. Part of the intake passage 46 is formed between the fixed base plate 14, third wall 12*f*, and partition wall 12*k*. An intake port formation recess 12*fa* is formed in an upper portion of the third wall 12*f*. The fixed base plate 14, center housing circumferential wall 12*c*, first wall 12*d*, second wall 12*e*, and third wall 12*f* encompass a void that forms part of the discharge chamber 31. Further, the fixed base plate 14, distal portion of the first wall 12*d*, third wall 12*f*, partition wall 12*k*, and center housing circumferential wall 12*c* encompass part of a continuous oil separation void T.

As shown in FIG. 2B, the closed end 13*a* of the rear housing 13 includes a third wall 13*f* that extends in the vertical direction and connects the first wall 13*d* and the second wall 13*e*. The third wall 13*f* has a clearance of a fixed distance from the partition wall 13*k*. Part of the intake passage 46 is formed between the closed end 13*a*, the third wall 13*f*, and the partition wall 13*k*. An intake port formation recess 13*fa* is formed in an upper portion of the third wall 13*f*. The closed end 13*a*, the rear housing circumferential wall 13*c*, the first wall 13*d*, the second wall 13*e*, and the third wall 13*f* encompass a void that forms part of the discharge chamber 31. Further, the closed end 13*a*, the distal portion of the first wall 13*d*, the third wall 13*f*, the partition wall 13*k*, and the rear housing circumferential wall 13*c* encompass part of a continuous oil separation void T.

Referring to FIG. 3, when the center housing 12 and rear housing 13 are coupled to each other, the two discharge chambers 31 are joined with each other to form a single discharge chamber 31 in the housing. Further, when the center housing 12 and the rear housing 13 are coupled to each other, the two intake passages 46 are joined with each other to form a single intake passage 46 in the housing. The intake port formation recesses 12*fa* and 13*fa* are also joined with each other thereby forming an intake port 46*a*, which communicates the discharge chamber 31 and the intake passage 46. Additionally, when the center housing 12 and rear housing 13 are coupled to each other, the two passage formation portions 12*ka* and 13*ka* are joined with each other to form the exhaust passage 47 in the housing.

The two oil separation voids T are joined with each other to form a single oil separation void T in the housing. The oil separation void T includes a section forming the oil separation compartment 41 that is located below the intake passage 46 and exhaust passage 47 and encompassed by the distal portions of the first walls 12*d* and 13*d*. The oil separation void T also includes a section forming the supply passage 48, which extends diagonally upward from the oil separation compartment 41. Further, the oil separation void T includes a section forming the oil reservoir 44 that is located downward from the supply passage 48 and below the first walls 12*d* and 13*d*. The intake passage 46, oil separation compartment 41, exhaust passage 47, supply passage 48, and oil reservoir 44 form an oil separation structure arranged between the discharge chamber 31 and the outlet 12*g*.

The intake passage 46, exhaust passage 47, oil separation compartment 41, supply passage 48, and oil reservoir 44 will now be described in detail.

The intake passage 46 includes one end in communication with the discharge chamber 31 through the intake port 46*a* and another end in communication with the oil separation compartment 41. Accordingly, the intake passage 46 extends upward from the oil separation compartment 41 and is in communication with the discharge chamber 31. The intake passage 46 has a smaller diameter (i.e., cross-sectional area) than the discharge chamber 31. Refrigerant gas is drawn from the discharge chamber 31 through the intake port 46*a* into the intake passage 46.

Upper surfaces of the first walls 12*d* and 13*d* form a bottom surface of the oil separation compartment 41. The bottom surface is recessed in an arcuate manner. Thus, the lubrication oil drawn into the oil separation compartment 41 from the intake passage 46 is conveyed along the arcuate bottom surface of the oil separation compartment 41, and the refrigerant gas whirls along the bottom surface of the oil separation compartment 41.

The exhaust passage 47 includes one end, which is in communication with the oil separation compartment 41, and another end, which is in communication with the muffler compartment 40. Accordingly, the exhaust passage 47 extends upward from the oil separation compartment 41 and is in communication with the muffler compartment 40. The end of the exhaust passage 47 that is in communication with the oil separation compartment 41 defines an inlet 47*a* into which refrigerant gas flows from the oil separation compartment 41. The portion of the exhaust passage 47 other than the inlet 47*a* forms a large diameter portion having a larger diameter (i.e., cross-sectional area) than the inlet 47*a*. The refrigerant gas drawn into the oil separation compartment 41 enters the inlet 47*a* of the exhaust passage 47. Then, the refrigerant gas expands at the large diameter portion. This decreases the flow velocity of the refrigerant gas. In this state, the refrigerant gas enters the muffler compartment 40.

The supply passage 48 extends upward from the oil separation compartment 41. More specifically, the supply passage 48 extends diagonally upward from the intake passage 46 at the oil separation compartment 41. Thus, the lubrication oil in the oil separation compartment 41 is conveyed diagonally upward along the wall surface of the oil separation compartment 41 and supplied to the supply passage 48. The supply passage 48 has a larger diameter (i.e., cross-sectional area) than the intake passage 46 and the exhaust passage 47 (inlet 47*a*). The intake passage 46, exhaust passage 47, and supply passage 48 are arranged in this order from the discharge chamber 31, and the exhaust passage 47 is arranged between the intake passage 46 and the supply passage 48.

The oil reservoir 44 is arranged below the supply passage 48. The oil reservoir 44 is a compartment for accumulating the lubrication oil that falls from the supply passage 48. As shown in FIG. 3, the supply passage 48 is arranged in the housing extending diagonally upward from the oil separation compartment 41, that is, in a direction intersecting the vertical direction of the oil separation compartment 41. Further, the oil reservoir 44 is arranged in the housing to extend downward from beside the oil separation compartment 41. The discharge chamber 31 is arranged diagonally upward from the oil separation compartment 41. As shown in FIGS. 1 and 2A, the center housing circumferential wall 12*c* of the center housing 12 includes an oil supply communication passage 12*h*, which communicates the oil reservoir 44 and the suction chamber 30. The oil supply communication passage 12*h* extends over one half of the center housing circumferential wall 12*c*.

The operation of the scroll compressor 10 will now be described.

The refrigerant gas compressed in the compression unit C and discharged into the discharge chamber 31 enters the intake passage 46 through the intake port 46*a* and is drawn into the oil separation compartment 41 through the intake passage 46. The refrigerant gas is forced from the intake passage 46, which has a small diameter, into the oil separation compartment 41, which is a vast void, thereby increasing the flow velocity of the refrigerant gas. Thus, turbulence of the refrigerant gas is suppressed in the intake passage 46. Further, the refrigerant gas flows toward the oil separation compartment 41 in a laminar state at a substantially uniform velocity and blows into the oil separation compartment 41 through the outlet of the intake passage 46.

In the oil separation compartment 41, due to surface tension, lubrication oil is conveyed along the wall surface of the oil separation compartment 41. The refrigerant gas forces the lubrication oil on the wall surface of the oil separation compartment 41 away from the intake passage 46. Thus, the lubrication oil is conveyed along the bottom surface of the oil separation compartment 41 toward the supply passage 48. In the oil separation compartment 41, the refrigerant gas is directed upward along the bottom surface of the oil separation compartment 41 and drawn into the exhaust passage 47, which is in communication with the outlet 12*g*. Thus, the refrigerant gas forced into the oil separation compartment 41 is readily discharged from the exhaust passage 47 into the muffler compartment 40. Then, the refrigerant gas is discharged from the muffler compartment 40 through the outlet 12*g* and out of the housing of the scroll compressor 10.

The lubrication oil conveyed along the wall surface of the oil separation compartment 41 is directly supplied to the supply passage 48. The supply passage 48 has a larger diameter (i.e., cross-sectional area) than the intake passage 46 and the exhaust passage 47. This prevents the supply passage 48 from being filled with lubrication oil and smoothly supplies the supply passage 48 with lubrication oil. Then, the lubrication oil of the oil reservoir 44 is supplied through the oil supply communication passage 12*h* to the suction chamber 30.

The above embodiment has the advantages described below.

(1) The oil separation structure of the scroll compressor 10 includes the oil reservoir 44 in the housing and the oil separation compartment 41, which is located above the oil reservoir 44. Further, the intake passage 46, the exhaust passage 47, and the supply passage 48 extend upward from the oil separation compartment 41. The intake passage 46 is in communication with the discharge chamber 31, and the exhaust passage 47 is in communication with the outlet 12*g*. The supply passage 48 is in communication with the oil reservoir 44. The intake passage 46 has a smaller diameter (i.e., cross-sectional area) than the supply passage 48 and functions as a throttle. Thus, when refrigerant gas flows through the intake passage 46 and enters the oil separation compartment 41, the flow velocity of the refrigerant gas is increased in the intake passage 46. Further, the refrigerant gas forced into the oil separation compartment 41 is drawn into the exhaust passage 47, which is in communication with the outlet 12*g*, and discharged from the oil separation compartment 41. As a result, the lubrication oil suspended in the refrigerant gas remains collected on the wall surface of the oil separation compartment due to surface tension. Further, lubrication oil is efficiently separated from the refrigerant gas, and the escape of lubrication oil from the housing of the scroll compressor 10 together with refrigerant gas is impeded.

Further, there is no need for a separation tube that whirls the refrigerant gas to separate lubrication oil from the refrigerant gas. The oil separation structure efficiently separates lubrication oil from the refrigerant gas by merely arranging the oil separation compartment 41 above the oil reservoir 44 and extending the three passages 46, 47, and 48 from the oil separation compartment 41. This allows for reduction in the size of the oil separation structure, which extends in the vertical direction in the housing. Additionally, the oil separation structure can be reduced in size in comparison with when using a whirling type oil separation structure. Further, the location of the outlet 12*g* is not determined by the location of the separation tube, and the outlet 12*g* may be located in any position. This increases the freedom of layout for the scroll compressor 10.

Moreover, there is no need for a baffling passage used for refrigerant gas impingement and the arrangement of multiple impingement sections like in an impingement type oil separation structure. This allows for reduction in the size of the oil separation structure and a decrease in the energy loss that results from the impingement of refrigerant gas.

Additionally, the supply passage 48 has a larger diameter (i.e., cross-sectional area) than the intake passage 46 and has a large volume. Thus, the lubrication oil separated from the refrigerant gas in the oil separation compartment 41 does not clog the supply passage 48 when being transferred through the supply passage 48. This smoothly supplies the separated lubrication oil from the oil separation compartment 41 to the supply passage 48. Further, the supply passage 48 extends upward from the oil separation compartment 41. Thus, when the lubrication oil separated in the oil separation compartment 41 is transferred along the wall surface of the oil separation compartment 41 toward the supply passage 48, the velocity of the lubrication oil falls. This prevents the lubrication oil from entering the supply passage 48 with great force, and the supply of the separated lubrication oil prevents the oil surface from being disturbed in the oil reservoir 44. Further, sufficient volume can be ensured for the supply passage 48. Thus, the lubrication oil does not overflow from the supply passage 48, and the lubrication oil in the supply passage 48 is prevented from flowing backward to the oil separation compartment.

(2) In the oil separation structure of the scroll compressor 10, the intake passage 46 has a smaller diameter (i.e., cross-sectional area) than the supply passage 48 and functions as a throttle. Thus, when the refrigerant gas flows through the intake passage 46, the refrigerant gas is prevented from becoming turbulent, and refrigerant gas is allowed to flow toward the oil separation compartment 41 at a generally constant flow velocity. This suppresses the collection of lubrication oil on the wall surface of the intake passage 46 that would occur when the refrigerant gas is turbulent, and most of the lubrication oil can be separated in the oil separation compartment 41.

(3) The inlet 47*a*, which is connected to the oil separation compartment 41 in the exhaust passage 47, is narrowed, and the portion of the exhaust passage 47 located toward the outlet 12*g* from the inlet 47*a* has a larger diameter. Thus, the large diameter portion decreases the flow velocity of the refrigerant gas drawn into the exhaust passage 47. If the flow velocity were to remain high in the exhaust passage 47, the lubrication oil would be carried by the refrigerant gas from the exhaust passage 47 to the muffler compartment 40 and then out of the scroll compressor 10. However, the decrease in the flow velocity impedes the escape of lubrication oil from the scroll compressor 10. Further, the decrease in the flow velocity of the refrigerant gas results in lubrication oil collecting more easily on the wall surface of the exhaust passage 47, and the lubrication oil can be separated when passing through the exhaust passage 47.

(4) The bottom surface of the oil separation compartment 41 is arcuate and curved from the intake passage 46 toward the supply passage 48. Thus, the flow of refrigerant gas, which blows into the oil separation compartment 41, along the bottom surface of the oil separation compartment 41 whirls refrigerant gas in the oil separation compartment 41. As a result, the whirling in the oil separation compartment 41 allows for centrifugal force to separate lubrication oil from the refrigerant gas, which blows into the oil separation compartment 41. Thus, in the oil separation compartment 41, the collection of lubrication oil on the wall surface and the centrifugal separation of the lubrication oil caused by the whirling can be efficiently performed.

(5) The bottom surface of the oil separation compartment 41 is arcuate and curved from the intake passage 46 to the supply passage 48. Thus, the lubrication oil collected on the wall surface proximal to the inlet of the oil separation compartment 41 is conveyed along the bottom surface of the oil separation compartment 41 and directly supplied to the supply passage 48.

(6) The oil separation compartment 41, the oil reservoir 44, and the supply passage 48 are formed by coupling the center housing 12 and the rear housing 13. Thus, the oil separation compartment 41, the oil reservoir 44, and the supply passage 48 extend over the two housings 12 and 13. This allows each of the oil separation compartment 41, the oil reservoir 44, and the supply passage 48 to have a larger volume as compared to when they are formed in, for example, only the rear housing 13. Further, the oil separation compartment 41 and the oil reservoir 44 can be formed merely by coupling the center housing 12 and the rear housing 13 in a state opposed to each other. This allows for the oil separation structure and, ultimately, the scroll compressor 10 to be easily manufactured with low costs.

(7) The oil separation structure of the scroll compressor 10 includes the intake passage 46, which is in communication with the discharge chamber 31, and the oil separation compartment 41, which is in communication with the intake passage 46. Further, the supply passage 48 and exhaust passage 47 are formed in communication with the oil separation compartment 41, and the oil reservoir 44 is formed in communication with the supply passage 48. By setting the diameters (i.e., cross-sectional area) of the intake passage 46 and supply passage 48 and the extending directions of the passages, lubrication oil can be efficiently separated from the refrigerant gas. Accordingly, the oil separation structure of the present embodiment completely differs from a structure in which a passage having a uniform diameter is merely meandered or a structure in which refrigerant gas merely impinges against sections of a passage.

(8) The intake passage 46, exhaust passage 47, and supply passage 48 are arranged in this order from the discharge chamber 31 in the housing. The exhaust passage 47 is arranged between the intake passage 46 and the supply passage 48. Thus, the refrigerant gas supplied from the intake passage 46 to the oil separation compartment 41 can readily be discharged from the exhaust passage 47 out of the oil separation compartment 41.

It should be apparent to those skilled in the art that the present invention may be embodied in many other specific forms without departing from the spirit or scope of the invention. Particularly, it should be understood that the present invention may be embodied in the following forms.

In the above embodiment, the oil separation compartment 41, the oil reservoir 44, the intake passage 46, the exhaust passage 47, and the supply passage 48 extend over the center housing 12 and the rear housing 13. However, the oil separation compartment 41, the oil reservoir 44, the intake passage 46, the exhaust passage 47, and the supply passage 48 may be formed in only the rear housing 13 or the center housing 12.

Figure 4:
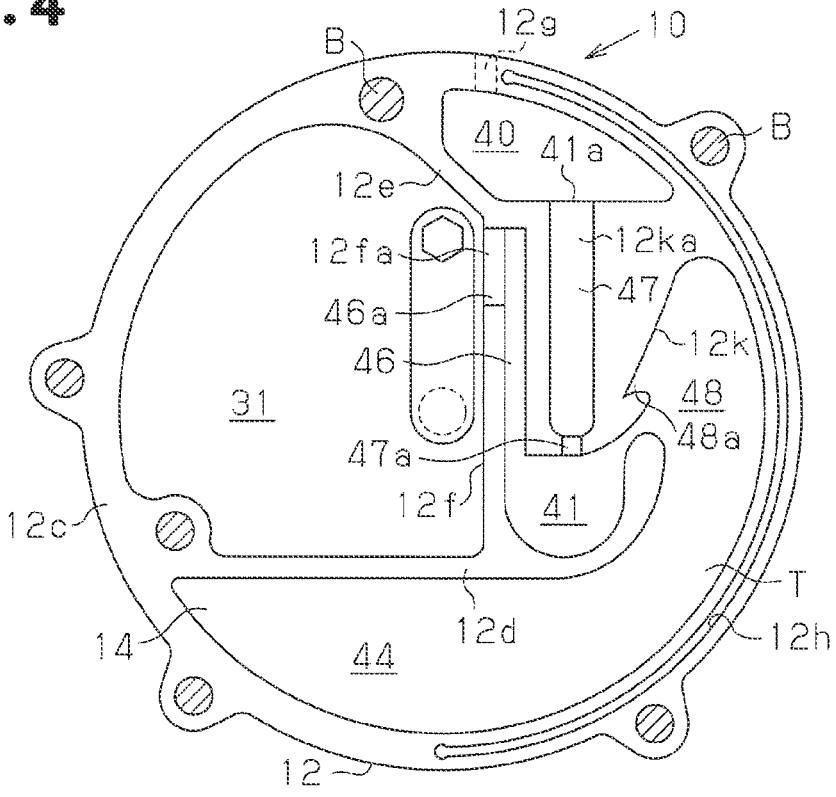
FIG. 4 is a diagram showing another example of a supply passage of FIG. 3.

As shown in FIG. 4, part of the supply passage 48 may be expanded to form a backflow preventing portion 48*a* that extends back toward the oil separation compartment 41 from the supply passage 48. More specifically, part of the partition walls 12*k* and 13*k* are cut out toward the oil separation compartment 41, and the cut out portion forms the backflow preventing portion 48*a*. In this structure, when lubrication oil flows along the wall surface of the supply passage 48, even if the lubrication oil flows backward toward the oil separation compartment 41, the lubrication oil would enter the backflow preventing portion 48*a*. This decreases the amount of lubrication oil that flows backward from the supply passage 48 to the oil separation compartment 41.

Figure 5:
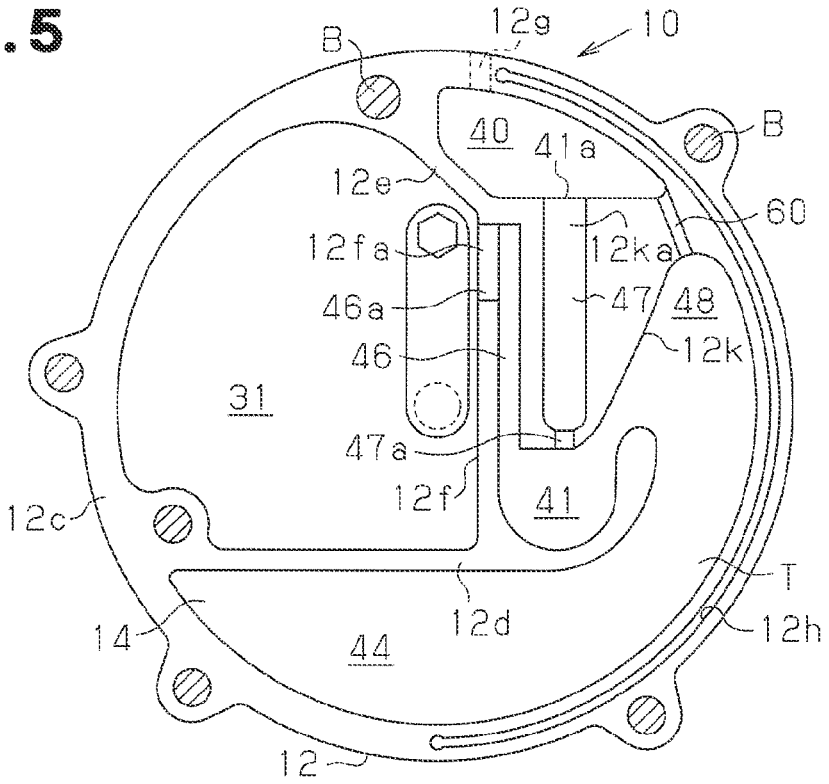
FIG. 5 is a diagram showing an example of a bypass passage that communicates an outlet and the supply passage.

As shown in FIG. 5, a bypass passage 60 may communicate the muffler compartment 40, which is a portion closer to the exhaust passage 47 than the outlet 12*g*, and the supply passage 48. In the muffler compartment 40, the refrigerant gas from the exhaust passage 47 expands. In this state, even when the lubrication oil escapes from the oil separation compartment 41, the expansion of the refrigerant gas in the muffler compartment 40 separates lubrication oil from the refrigerant gas. The separated lubrication oil in the muffler compartment 40 can be returned to the supply passage 48 through the bypass passage 60. This impedes the escape of lubrication oil from the housing of the scroll compressor 10.

Figure 6:
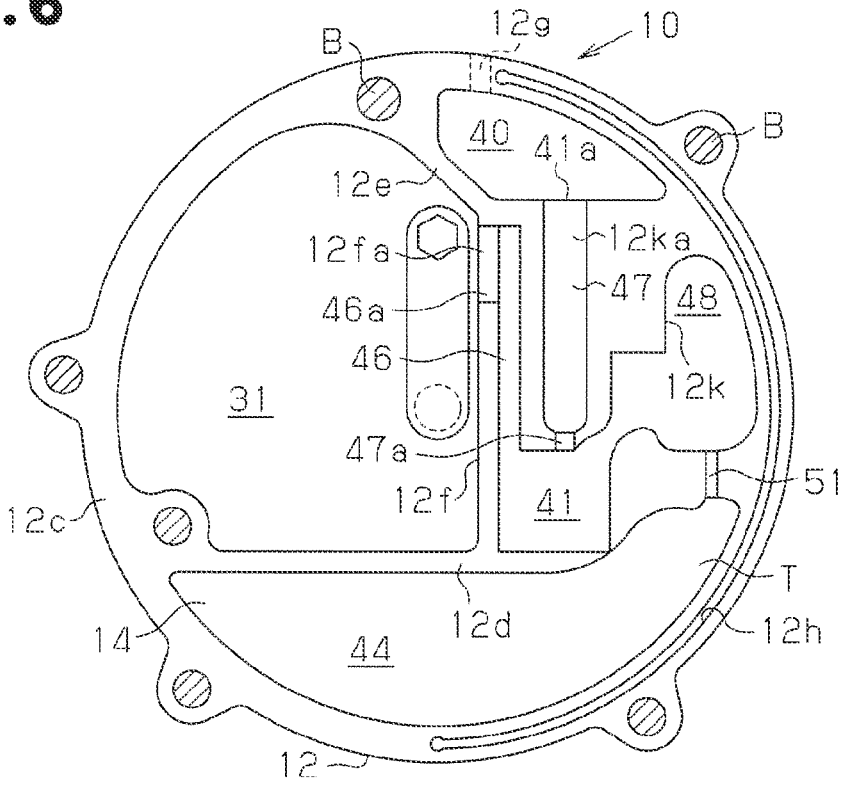
FIG. 6 is a diagram showing an example of a throttle arranged between the supply passage and an oil reservoir.

As shown in FIG. 6, a throttle 51 may be arranged between the supply passage 48 and the oil reservoir 44. In this structure, even when refrigerant gas flows to the supply passage 48, the throttle 51 prevents the refrigerant gas from flowing into the oil reservoir 44 with great force and prevents the refrigerant gas from disturbing the oil surface in the oil reservoir 44.

The bottom surface of the oil separation compartment 41 does not have to be recessed in an arcuate manner. For example, as shown in FIG. 6, the oil separation compartment 41 may be box-shaped.

Figure 7:
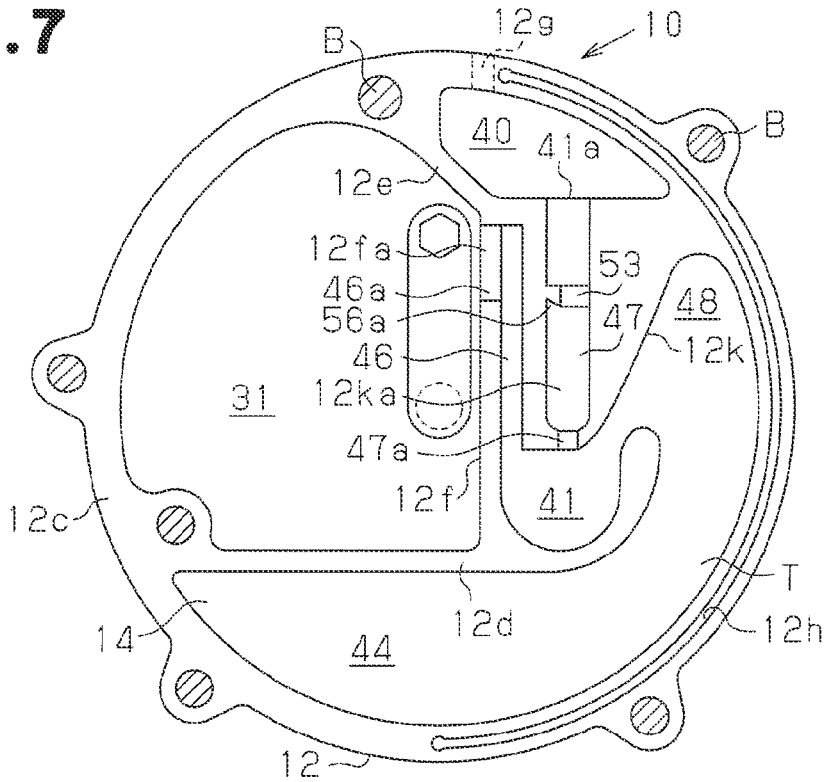
FIG. 7 is a diagram showing an example of a trap arranged in an exhaust passage.

As shown in FIG. 7, the exhaust passage 47 may include a throttle 53 formed by recessing the exhaust passage 47 in a direction intersecting the flow direction of the refrigerant gas in the exhaust passage 47. A trap 56*a*, which has a larger diameter than the throttle 53, is formed in the portion of the exhaust passage 47 closer to the oil separation compartment 41 than the throttle 53 of the exhaust passage 47. That is, the trap 56*a* is located at the upstream side of the throttle 53 in the exhaust passage 47. In this manner, the exhaust passage 47 includes the trap 56*a* and the throttle 53, which are formed continuously in the flow direction of the refrigerant gas, and the throttle 53 is formed at the downstream side of the trap 56*a*. The throttle 53 is formed by reducing the diameter of the exhaust passage 47 in a tapered manner toward the oil separation compartment 41. The trap 56*a* extends along the circulation direction of the refrigerant gas in the exhaust passage 47.

In this structure, when lubrication oil is conveyed along the wall surface of the exhaust passage 47, the lubrication oil enters the trap 56*a*. This decreases the amount of lubrication oil flowing to the muffler compartment 40 and impedes the escape of lubrication oil out of the scroll compressor 10.

Figure 8:
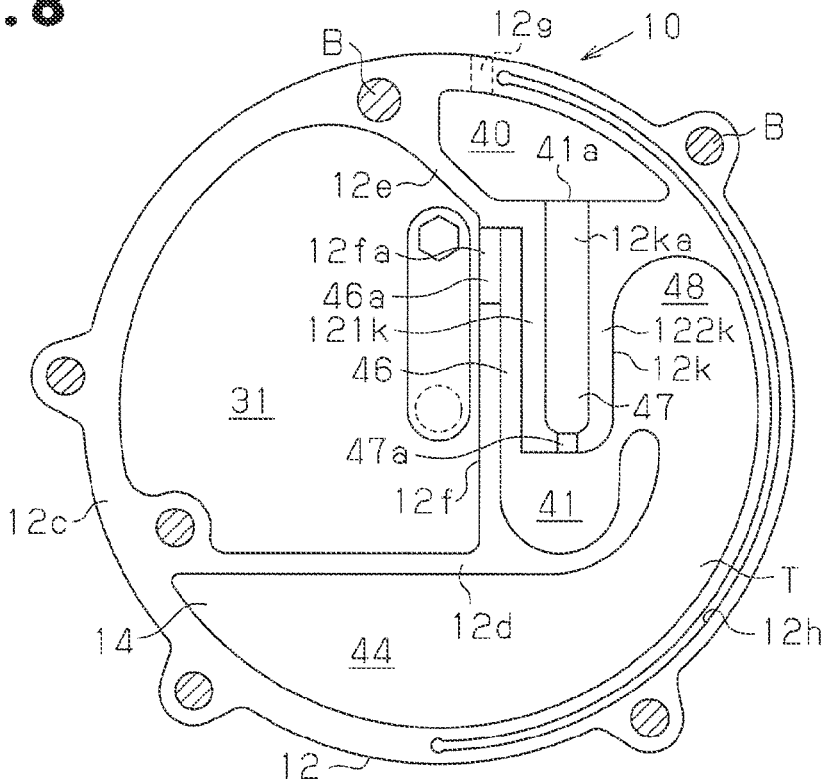
FIG. 8 is a diagram showing another example of an oil separation structure including parallel partition walls.
Figure 9A:
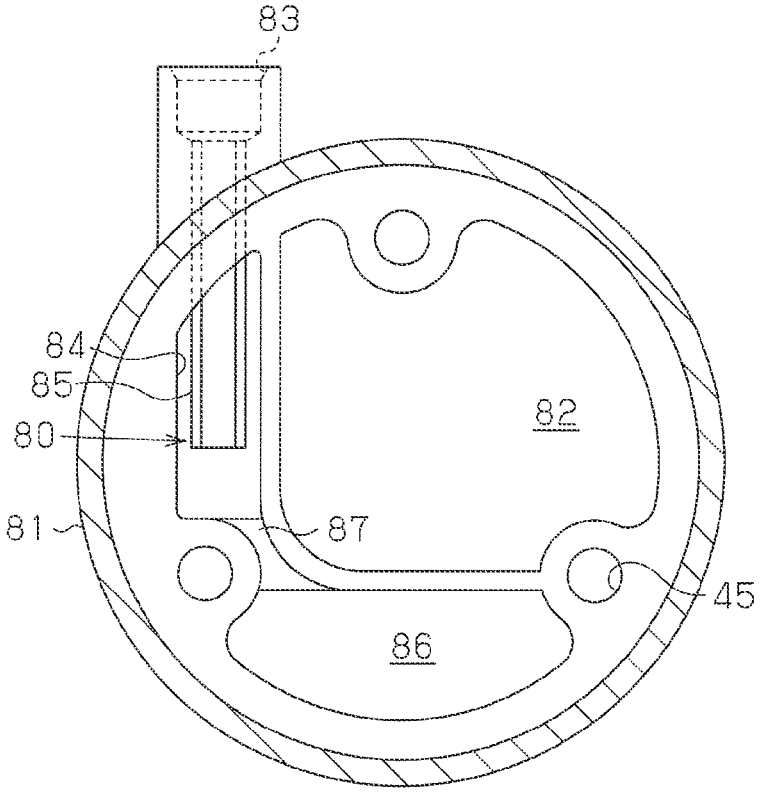
Fig.9A(Prior Art)
FIG. 9A is a cross-sectional view showing a whirling type oil separation mechanism.
Figure 9B:
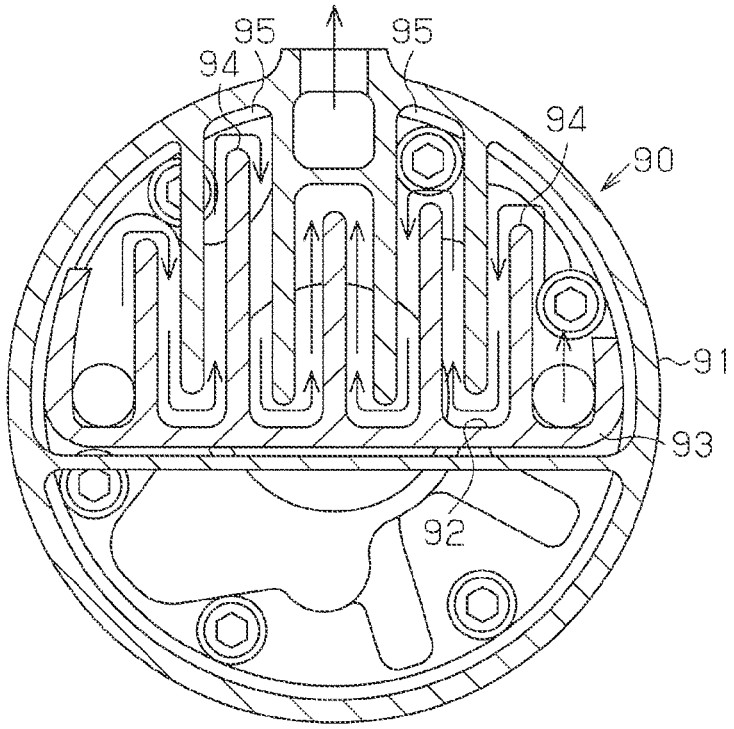
Fig.9B(Prior Art)
FIG. 9B is a cross-sectional view showing an impingement type oil separation structure.

As shown in FIG. 8, in the partition walls 12*k* and 13*k*, portions (first walls 121*k*) partitioning the intake passage 46 and the exhaust passage 47 may be formed parallel to portions (second wall 122*k*) partitioning the exhaust passage 47 and the supply passage 48. In this case, the exhaust passage 47 extends backward at 180 degrees from the intake passage 46. Further, part of the supply passage 48 extends backward at 180 degrees from the intake passage 46.

In this structure, part of the supply passage 48 (portion of the supply passage 48 proximal to the oil separation compartment 41) extends straight upward. This further ensures a decrease in the velocity of the lubrication, which is separated from the refrigerant gas in the oil separation compartment 41, conveyed along the wall surface of the oil separation compartment 41 toward the supply passage 48 and prevents the lubrication oil from entering the supply passage 48 with great force.

In the above embodiment, the intake passage 46, exhaust passage 47, and supply passage 48 are arranged in order from the discharge chamber 31. However, the arrangement order of the intake passage 46, exhaust passage 47, and supply passage 48 may be changed.

In the above embodiment, the compression unit C is of a scroll type. Instead, the compression unit C may be of a vane type.

The present examples and embodiments are to be considered as illustrative and not restrictive, and the invention is not to be limited to the details given herein, but may be modified within the scope and equivalence of the appended claims.

What is claimed:

1. A compressor comprising:

a housing;

a compression unit arranged in the housing, wherein the compression unit draws in, compresses, and discharges refrigerant gas;

a discharge chamber in communication with the compression unit;

an outlet in communication with the discharge chamber, wherein the outlet is formed in the housing to discharge the refrigerant gas out of the housing; and an oil separation structure arranged between the discharge chamber and the outlet, wherein the oil separation structure separates lubrication oil from the refrigerant gas and accumulates separated lubrication oil, and the oil separation structure includes:

an oil reservoir that accumulates the lubrication oil separated from the refrigerant gas, an oil separation compartment that is located upward from the oil reservoir and is in communication with the oil reservoir, an intake passage that extends upward from the oil separation compartment and is in communication with the discharge chamber, wherein the intake passage draws the refrigerant gas from the discharge chamber into the oil separation compartment to separate the lubrication oil from the refrigerant gas, an exhaust passage that extends upward from the oil separation compartment and is in communication with the outlet, wherein the exhaust passage discharges the refrigerant gas from the oil separation compartment through the outlet and out of the housing, and a supply passage that extends upward from the oil separation compartment and has a larger cross-sectional area than the intake passage, wherein the supply passage supplies the separated lubrication oil from the oil separation compartment to the oil reservoir.

2. The compressor according to claim 1, wherein the intake passage, the exhaust passage, and the supply passage are arranged next to one another, and the exhaust passage is arranged between the intake passage and the supply passage.

3. The compressor according to claim 1, wherein the exhaust passage includes an inlet, which is in communication with the oil separation compartment, and a large diameter portion, the large diameter portion is located at a downstream side of the inlet and has a larger cross-sectional area than the inlet.

4. The compressor according to claim 1, wherein the oil separation compartment includes a bottom surface that is recessed in an arcuate manner.

5. The compressor according to claim 1, wherein part of the supply passage, which extends from the oil separation compartment, forms a backflow preventing portion that extends back toward the oil separation compartment.

6. The compressor according to claim 1, wherein the oil separation structure includes a bypass passage that communicates the supply passage with a portion of the oil separation structure that is located closer to the exhaust passage than the outlet.

7. The compressor according to claim 1, wherein the oil separation structure includes a throttle arranged between the supply passage and the oil reservoir.

8. The compressor according to claim 1, wherein the exhaust passage includes a throttle recessed in the exhaust passage in a direction intersecting a direction in which the refrigerant gas flows through the exhaust passage, and a trap located in a portion of the exhaust passage that is closer to the oil separation compartment than the throttle, and the trap has a larger cross-sectional area than the throttle.

9. The compressor according to claim 1, wherein the housing includes a first wall that partitions the intake passage and the exhaust passage, and a second wall that partitions the exhaust passage and the supply passage, wherein the first wall and the second wall extend parallel to each other.

10. The compressor according to claim 1, further comprising:

a suction chamber that draws in the refrigerant gas; and an oil supply communication passage that communicates the suction chamber and the oil reservoir.

11. The compressor according to claim 1, wherein the housing includes a plurality of housing formation members, and the oil separation compartment and the oil reservoir are formed by coupling the housing formation members.

* * * * *